US008877328B2

(12) United States Patent
Bauer et al.

(10) Patent No.: US 8,877,328 B2
(45) Date of Patent: Nov. 4, 2014

(54) VALUE DOCUMENT WITH PRINTED AREAS PARTLY COVERED WITH FOIL

(75) Inventors: Michael Bauer, Gernlinden (DE); Werner Bochmann, Ismaning (DE)

(73) Assignee: Giesecke & Devrient GmbH, Munich (DE)

( * ) Notice: Subject to any disclaimer, the term of this patent is extended or adjusted under 35 U.S.C. 154(b) by 1245 days.

(21) Appl. No.: 10/531,389

(22) PCT Filed: Oct. 16, 2003

(86) PCT No.: PCT/EP03/11467

§ 371 (c)(1), (2), (4) Date: Sep. 28, 2005

(87) PCT Pub. No.: WO2004/037548

PCT Pub. Date: May 6, 2004

(65) Prior Publication Data

US 2006/0107854 A1 May 25, 2006

(30) Foreign Application Priority Data

Oct. 18, 2002 (DE) ..... 102 48 868

(51) Int. Cl.
*B32B 3/00* (2006.01)
*B42D 25/00* (2014.01)

(52) U.S. Cl.
CPC ..... *B42D 15/10* (2013.01); *B42D 2037/08* (2013.01); *B42D 2035/28* (2013.01)
USPC ..... 428/204; 101/492; 101/150; 101/153; 101/154; 283/70

(58) Field of Classification Search
USPC ..... 428/195.1, 204; 283/7, 70; 101/492, 101/150, 153, 154
See application file for complete search history.

(56) References Cited

U.S. PATENT DOCUMENTS

| | | | | | |
|---|---|---|---|---|---|
| 3,897,964 | A | * | 8/1975 | Oka et al. | 283/111 |
| 3,980,018 | A | * | 9/1976 | Ichikawa | 101/170 |
| 4,324,421 | A | * | 4/1982 | Moraw et al. | 283/75 |
| 4,325,196 | A | * | 4/1982 | Gauch et al. | 283/75 |
| 4,715,623 | A | * | 12/1987 | Roule et al. | 283/91 |
| 5,310,222 | A | * | 5/1994 | Chatwin et al. | 283/86 |
| 5,433,807 | A | * | 7/1995 | Heckenkamp et al. | 156/230 |
| 5,801,857 | A | * | 9/1998 | Heckenkamp et al. | 359/2 |
| 5,915,731 | A | * | 6/1999 | Jackson | 283/91 |
| 6,060,143 | A | * | 5/2000 | Tompkin et al. | 428/64.1 |

(Continued)

FOREIGN PATENT DOCUMENTS

| | | |
|---|---|---|
| CH | 690 529 A5 | 9/2000 |
| DE | 100 44 464 A1 | 3/2002 |

(Continued)

OTHER PUBLICATIONS

Römpp Chemie Lexikon Cm-G Thieme Verlag, ISBN 3-13-734709-2, pp. 1-7, copyright 1990.*

*Primary Examiner* — D. Lawrence Tarazano
*Assistant Examiner* — Tamra L Dicus
(74) *Attorney, Agent, or Firm* — Rothwell, Figg, Ernst & Manbeck, P.C.

(57) ABSTRACT

The invention relates to a data carrier having at least one printed area produced by intaglio printing and partly covered with a film, and to a method for producing said data carrier.

17 Claims, 2 Drawing Sheets

(56) References Cited

U.S. PATENT DOCUMENTS

| | | | | |
|---|---|---|---|---|
| 6,062,604 | A * | 5/2000 | Taylor et al. | 283/72 |
| 6,098,546 | A * | 8/2000 | Schell | 101/492 |
| 6,283,509 | B1 * | 9/2001 | Braun et al. | 283/91 |
| 6,337,752 | B1 * | 1/2002 | Heckenkamp et al. | 359/2 |
| 6,471,248 | B2 * | 10/2002 | Hardwick et al. | 283/72 |
| 6,474,695 | B1 * | 11/2002 | Schneider et al. | 283/72 |
| 6,505,779 | B1 * | 1/2003 | Power et al. | 235/488 |
| 6,928,925 | B1 * | 8/2005 | Mayer et al. | 101/150 |
| 6,954,293 | B2 * | 10/2005 | Heckenkamp et al. | 359/2 |
| 7,311,043 | B2 * | 12/2007 | Mayer et al. | 101/150 |
| 7,357,077 | B2 * | 4/2008 | Adamczyk et al. | 101/170 |
| 2001/0000236 | A1 * | 4/2001 | Benoit et al. | 428/500 |
| 2002/0027361 | A1 | 3/2002 | Hardwick et al. | |
| 2002/0117846 | A1 | 8/2002 | Kaule et al. | |
| 2008/0290647 | A1 * | 11/2008 | Adamczyk et al. | 283/72 |

FOREIGN PATENT DOCUMENTS

| | | | |
|---|---|---|---|
| EP | 0 461 475 | A1 | 12/1991 |
| WO | WO 01/49505 | A1 | 7/2001 |
| WO | WO 02/04234 | A1 | 1/2002 |

* cited by examiner

VALUE DOCUMENT WITH PRINTED AREAS PARTLY COVERED WITH FOIL

CROSS-REFERENCE TO RELATED APPLICATION

This application is a National Phase of International Application Serial No. PCT/EP03/11467, filed Oct. 16, 2003.

FIELD OF THE INVENTION

This invention relates to a data carrier having at least one printed area produced by intaglio printing and partly covered with a foil, and to a method for producing said data carrier.

DESCRIPTION OF THE BACKGROUND ART

Data carriers according to the invention are in particular security or value documents, such as bank notes, identity cards, passports, visa stickers, check forms, shares, certificates, postage stamps, air tickets and the like, as well as labels, seals, packages, or other elements for product protection. The simplifying designation "data carrier" and "security or value document" will therefore hereinafter always include documents of the stated type.

Such papers whose market value or utility far exceeds the value of the material require suitable measures to make them recognizable as authentic and distinguishable from imitations and forgeries. They are therefore provided with special security elements which are ideally not, or only with great effort, imitable and not falsifiable.

In the past particularly those security elements have proved useful that can be identified and recognized as authentic by the viewer without aids but are simultaneously only producible with extremely great effort. These are e.g. motifs produced by intaglio printing, which are characterized by their typical tactility easily recognizable even to the layman, and cannot be imitated with other common printing processes or by copy machines.

Line or intaglio printing, in particular steel intaglio printing, is an important technique for printing data carriers, in particular papers of value, such as bank notes and the like.

Intaglio printing is characterized by engraving or etching depressions into the printing plates to produce a printed image. The ink-transferring areas of the printing plate are thus present as depressions in the printing plate surface.

Before the actual printing operation, ink of pasty consistency is applied to the engraved printing plate and surplus printing ink removed from the surface of the printing plate by means of a wiping blade or wiping cylinder, so that ink remains only in the depressions. Then a substrate, as a rule paper, is pressed against the printing plate and thus also into the ink-filled depressions of the printing plate, and removed again, whereby ink is drawn out of the depressions of the printing plate, sticks to the substrate surface and forms a printed image there. If transparent inks are used, the thickness of inking determines the shade. A light shade is thus obtained when a white data carrier is printed with small ink layer thicknesses, and darker shades when it is printed with thick ink layers. The ink layer thickness is in turn dependent to some degree on the engraving depth.

Intaglio printing allows relatively thick inking on a data carrier in comparison with other common printing methods such as offset printing. The comparatively thick ink layer produced by intaglio printing, together with the partial deformation of the paper surface resulting from the paper being pressed into the engraving of the printing plate, is easily palpable manually even to the layman and thus also readily recognizable as an authenticity feature by its tactility. The tactility cannot be imitated with a copy machine, so that line intaglio printing offers high-quality protection against forgeries.

However, these printed images show signs of wear particularly in documents, such as bank notes and identification documents, that are exposed to strong mechanical and chemical loads, and are moreover openly accessible to tampering.

To increase falsification security, in particular of identification documents such as passports, one page of the passport bearing the personal data to be specially protected, such as name, date of birth, photo, signature, etc., is therefore usually provided with a transparent foil structure printed partly on the inner side, so that said data are not directly accessible. The production of such a passport is described for example in EP 0 364 730 A2.

In such foil-coated documents the data are no longer accessible to direct access from outside, but they are also no longer tactilely perceptible if executed by intaglio printing.

SUMMARY OF THE INVENTION

The invention is therefore based on the problem of providing a data carrier that offers high protection from forgery and avoids the disadvantages of the prior art.

A further problem is to provide a method for producing the inventive data carrier.

The invention is based on at least one printed area provided on the data carrier and produced by intaglio printing being covered partly with a foil.

A part of the printed area is thus accessible to a tactile check, while the remaining printed area is covered by a foil. The foil can be applied to the data carrier such that not only a part of the printed area but also sensitive further data, such as the above-mentioned personal data, are covered in identification documents. The data page to be protected is preferably, in particular in identification documents such as passports, provided with a foil all over except for the inventive partial cover.

The partial cover of the printed image by foil is preferably realized by the foil having at least one gap under which the printed area is disposed according to the invention. The gap is to be selected such that printed area and foil overlap. In particular it is preferable if the gap and the printed area are disposed so as to be as centered as possible relative to each other and the gap is smaller than the area of the printed image. The area of the gap is preferably to be selected such that an easy check of tactility is possible but, on the other hand, the foil can still perform its protective function. In particular, the area of the gap is approx. 1 to 4 $cm^2$.

The printed area can show any motif desired. It is particularly preferred to use motifs that are elaborate to print, in particular finely structured printed images, such as guilloches, alphanumeric characters, etc. The areal extension of the printed area need not meet any further requirements. Thus, the total surface of the document can be printed by intaglio printing, or else one or more limited areas. Advantageously the printed area is at least large enough to be easily visible and tactilely checkable. The minimum area of such an area is thus preferably about 1 to 4 $cm^2$.

In a preferred embodiment, the tactility and thus the surface relief is not equally pronounced over the total printed area. Particularly preferably, the tactility and thus the surface relief is greater at least in certain areas in the area not covered with foil than in the area covered with foil. The increased tactility can be obtained by more inking and stronger embossing of the printed or embossed substrate. This is normally obtained by deeper engravings in the printing plate used. In the printed area covered with foil the tactility is preferably weakly to hardly pronounced, i.e. the embossing of the substrate and the inking are low here. This has the advantage that the foil can be applied to a substrate with slight unevenness, which optimizes the cohesion of substrate and foil. Splitting of the foil-substrate laminate is thus reduced, while the tactile properties of the non-covered printed area are simultaneously retained or even increased.

In particular with very thin foils with thicknesses of e.g. under 15 μm, which are more inclined to chip or break open in the laminate, it is expedient to use a flat intaglio print in the area of overlapping of foil with the printed area.

The different tactility of the printed area can optionally be visualized depending on the type of printing ink used. When transparent printing inks are used, the color effect is dependent on the printed ink layer thickness, i.e. the thicker the ink is printed, the darker the printed image appears, and vice versa. When opaque printing inks are used, the brightness impression is independent of ink layer thickness. With a skillful choice of printing inks and ink layer thicknesses the appearance of the printed area can make the tactility of the motif recognizable to the naked eye or not.

Since tactile perception is a subjective sensation, a value as of which a relief is tactilely perceived can only be determined within rough limits. The tactile perceptibility of a printed image relief depends not only on the absolute relief height and the individual sensitivity but also on the areal extension of the printed structure and on whether the printed structure to be felt stands alone or is integrated into reliefed surroundings.

As rough guidelines, however, the following statements can be made. A printed relief produced by intaglio printing is tactilely perceptible below a relief height of approx. 50 μm. Relief areas between approx. 50 μm and 60 μm are readily perceptible. At relief amplitudes over 60 μm the intaglio printed relief becomes clearly perceptible.

It must be taken into account that a relief on the data carrier surface does not identically match the engraving depth of the printing plate. The surface relief produced by the print is composed of a compression of substrate material and the applied ink layer. The total height of the relief is based on the normal, i.e. unprinted and unembossed, data carrier surface. In practice the relief produced on the substrate and the engraving present in the printing plate differ considerably from each other. The reason for the deviations between engraving depth and relief height could be that the data carrier is not pressed in down to the bottom of the printing plate engraving during the printing operation and the ink present in the depressions of the printing plate is also not transferred completely to the data carrier. Correspondingly, the engraving depth of the printing plate for reliefed structures is in the range of approx. 40 μm to 250 μm, preferably in the range of approx. 55 μm to 150 μm. They produce relief structures in the range of approx. 5 μm to 100 μm, preferably 25 to 80 μm. Whether an engraving depth in the borderline range leads to a print that is rather reliefed or rather flat on the surface of a data carrier also depends in individual cases on the edge steepness of the engraving, the nature of the substrate to be printed (strength, plastic deformability) and the color properties.

Since the relief height achieved in the printing result depends not only on the engraving depth of the printing plate but also on the properties of the substrate and the printing ink, as mentioned above, an engraving depth of 40 μm can in extreme cases already lead to a reliefed printed image, while with other material and printing parameters an engraving depth of 50 μm can still lead to a flat printed image. In each concrete application case, however, the engravings leading to reliefed printed image areas are always deeper than ones that produce so-called flat, tactilely imperceptible image areas.

The intaglio printing is preferably done with intaglio printing plates produced by engraving with a fast rotating, tapered graver, for example by a method described in WO 97/48555. The engraving technique of so-called "separating edges" according to WO 00/20216 and WO 00/20217 is preferably also used. The engravings can fundamentally also be produced by laser engraving or etching or any other suitable removal method.

Normally the foil is accordingly cut, preferably a gap punched out. In the case of gaps the falsification security can be increased further if complicated punching patterns are used, e.g. wavy or jagged edges, star-shaped gaps, etc. To permit an easy check of the tactility of the exposed printed area, circular or almost square forms are preferable to prolonged, narrow gaps.

The foil normally has a thickness of approx. 6 to 150 μm. It is preferable to use very thin foils that cannot readily, i.e. without being destroyed, be removed from the data carrier. In particular, foils are used that have a thickness of less than 15 μm, particularly preferably from approx. 6 to 8 μm. In embodiments in which thicker foils are desired, foils with a thickness of approx. 100 to 130 μm are preferably used.

The foils can themselves be equipped with further security elements. Preferably the foil has diffraction structures, such as holographic embossed structures.

The foil materials used can be e.g. polyethylene terephthalate (PET) or selected thermoplastics. The foils should be at least translucent, preferably transparent, and can optionally also be colored.

The foil is applied to the substrate printed by intaglio printing e.g. by means of hot lamination or gluing. The positioning of the foil, in particular of foils with gaps, over the substrate is preferably done by means of position marks on foil and substrate.

Suitable substrates or data carrier materials are all substrate materials that can be used for intaglio printing, such as paper, plastic, plastic foil laminated or coated paper, as well as multilayer composite materials. It is preferable to use paper, in particular based on cotton fibers.

The inventively printed data carriers have increased falsification security since they are not reproducible with common printing processes due to the characteristic intaglio printed image and offer a characteristic printed or embossed image easily recognizable even to laymen. The tactilely perceptible image elements additionally offer effective protection against imitation by color photocopying or scanning of the data carriers. Additionally the data on the value document are reliably protected from attempts at tampering by the laminated foil. The present invention therefore combines in a unique way the advantages of tactile intaglio printed elements with foils as a protective cover. The foils prevent not only unauthorized access, but also improve the fitness for circulation and dirt resistance of the thus protected data carrier.

If the foil film is brought over the printed area according to the invention, in particular such that the printed motif continues essentially seamlessly under the foil, the protection from forgery is particularly great because the areas not covered with the foil cannot readily be cut out and transferred to other documents. "Seamlessly" does not necessary mean "without interruption" according to the invention. Along with unbroken lines and patterns, it is of course also possible to use printed images that convey to the viewer the impression of a continuous course, e.g. dashed lines or dotted areas whose individual elements are difficult to resolve optically with the naked eye. The motif transition between areas not covered with foil and areas covered with foil cannot be reproduced by simple cutting and gluing, in particular with finely structured patterns, i.e. it is impossible to glue areas in exact register to documents to be forged. Possible attempts at forgery are already easily recognizable with the naked eye or with simple aids such as a magnifying glass.

Further, it is advantageous that the printing operation can be carried out with one printing plate and thus the different requirements for tactility can be achieved in one printing operation.

The advantages of the invention will be explained with reference to the following examples and supplementary figures. The described individual features and embodiments described hereinafter are inventive taken per se but also in combination. The examples constitute preferred embodiments, but the invention is in no way limited thereto. The proportions shown in the figures do not necessarily correspond to the relations existing in reality and serve primarily to improve clearness.

DETAILED DESCRIPTION OF THE INVENTION

Figure 1:
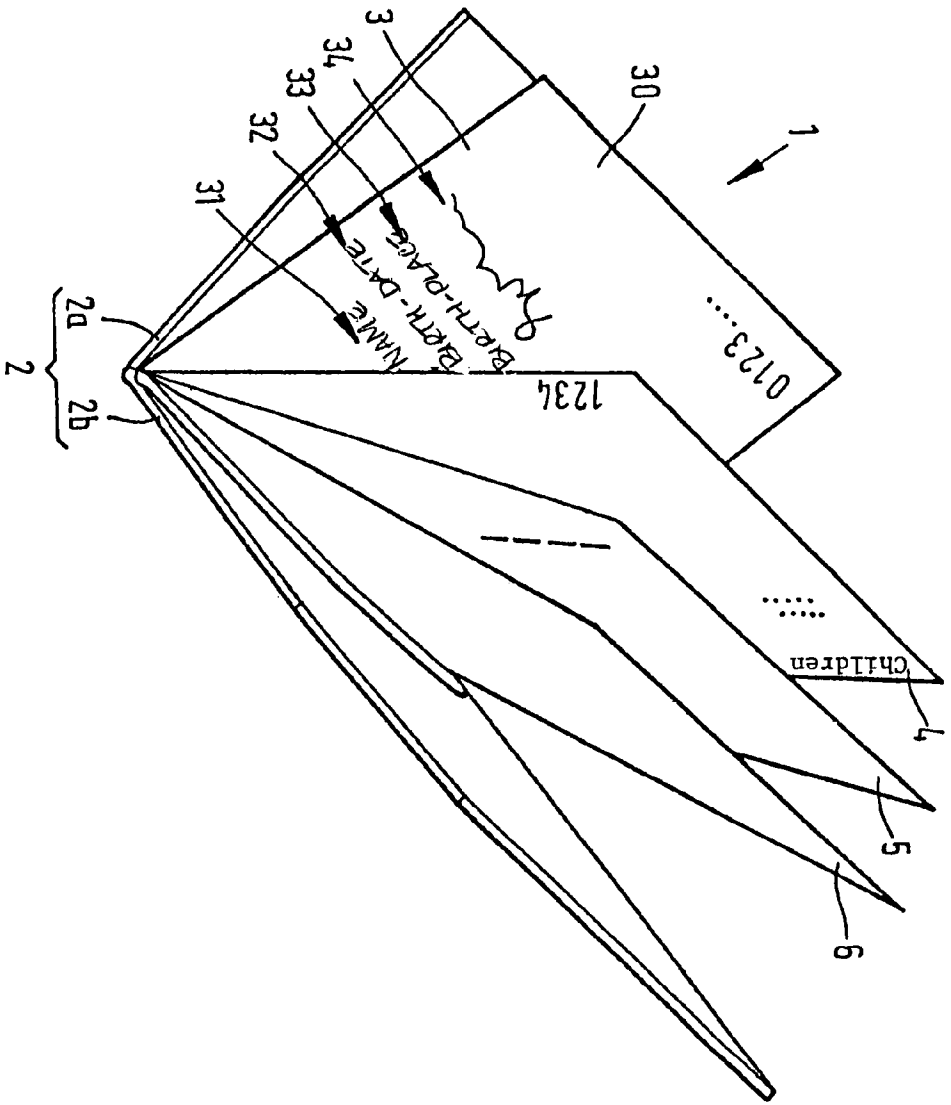
FIG. 1 shows a perspective view of an open passport.

FIG. 1 shows a passport 1 comprising a plastic or linen cover with a front cover sheet 2*a* and a back cover sheet 2*b*, an inventive personalization page 3, a second data sheet 4, a third data sheet 5 and an empty sheet 6. The sheets 4, 5 and 6 as well as any further empty sheets (not shown) preferably consist of paper or another material with a surface condition that permits later entries (extensions, visas, etc.). The sheet 4 bears for example details on children of the passport holder. At the bottom edge of the data sheet 4 there is a punched-in passport number. The personalization page 3 constitutes the inventive data sheet and consists of two transparent cover foils enclosing therebetween a paper inlay provided with different elements. The data sheet 3 has in the present case a smooth surface area 30 in which machine-readable data lines are disposed. Furthermore, the data sheet 3 bears the name 31, date of birth 32, place of birth 33 and signature 34 of the holder of said passport 1. The holder-related data, like the machine-readable data, are entered in the as yet unlaminated data sheet 3 e.g. by an ink jet printer. Then the lamination of the cover foil is done. Besides all these data, the identification document can of course be provided with further information and security elements depending on the intended use. Thus, the passport can have for example a photo of the passport holder likewise incorporated by ink jet printing.

Figure 2:
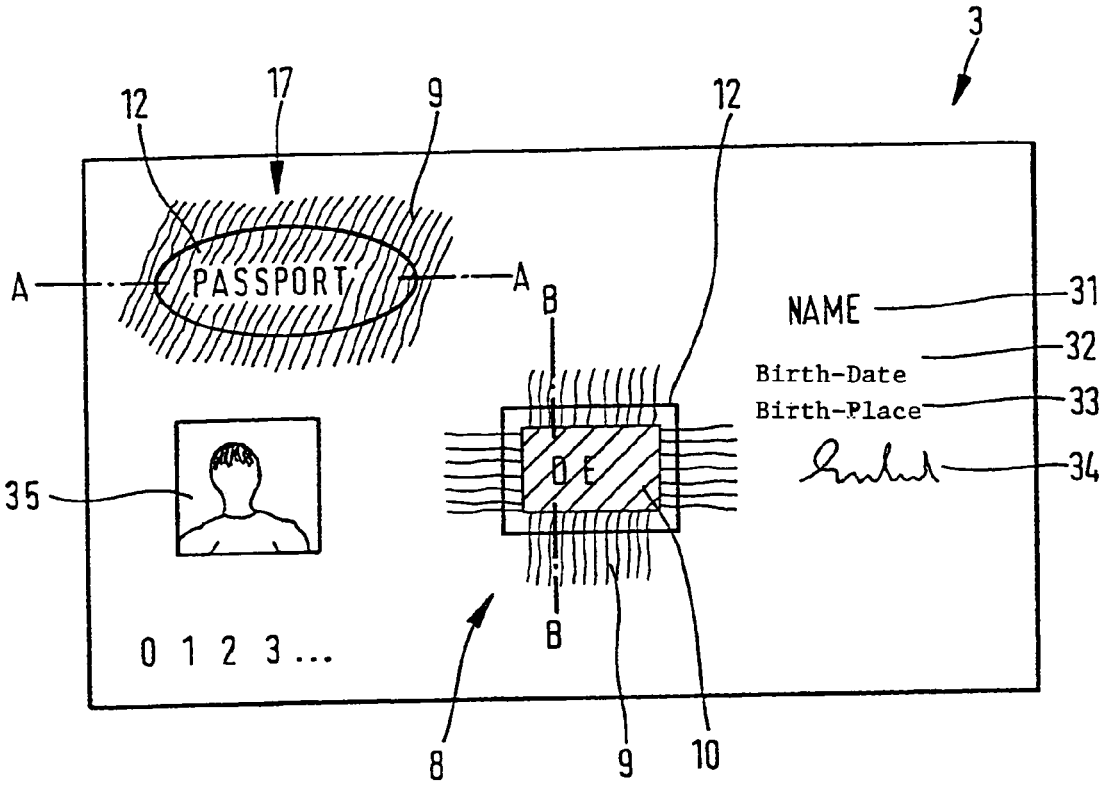
FIG. 2 shows a personalized data page in a top view.

FIG. 2 shows the personalized data page 3 from FIG. 1 in a top view with holder-related data such as name 31, date of birth 32, place of birth 33, signature 34, the photo 35 of the holder and the inventive areas 7 and 8. The finely structured guilloche background pattern 9 in the area 7, 8 and the writing "PASSPORT" as well as the sequence of letters "DE" e.g. for the country of issue are printed by intaglio printing. The area 8 moreover has a blind-embossed area 10. The data page was laminated with a foil which has an oval gap and a rectangular gap over the areas 7 and 8.

Looking more closely at the area 7, one can see that the finely structured background pattern 9 extends seamlessly from the area not covered with foil to the area covered with the foil. The writing "PASSPORT" can be easily detected tactilely. When scanning the area from left to right with his finger the checking person can at first not detect any roughness tactilely in the area of the foil. When moving his finger further to the right he can already clearly perceive, despite the constant pattern, a tactile effect which increases toward the middle of the gap in the area "PASSPORT" and then decreases again toward the right to the reverse extent.

Figure 3:
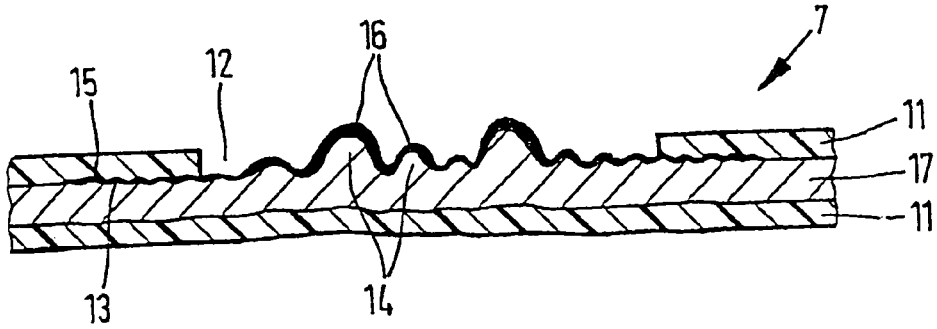
FIG. 3 shows a cross section through an inventive area along A-A in FIG. 2.

FIG. 3 shows the area 7 depicted in FIG. 2, in cross section along the line A-A. The substrate 17, preferably cotton paper, is coated with foil 11 on the front and back, the foil having an inventive—here oval—gap 12 on the front. Furthermore, the substrate is printed with intaglio printing that is tactilely perceptible to different extents. The guilloche pattern 9 shows weak embossing 13 and little inking 15, while the writing "PASSPORT" shows strong embossing 14 and thicker inking 16.

Figure 4:
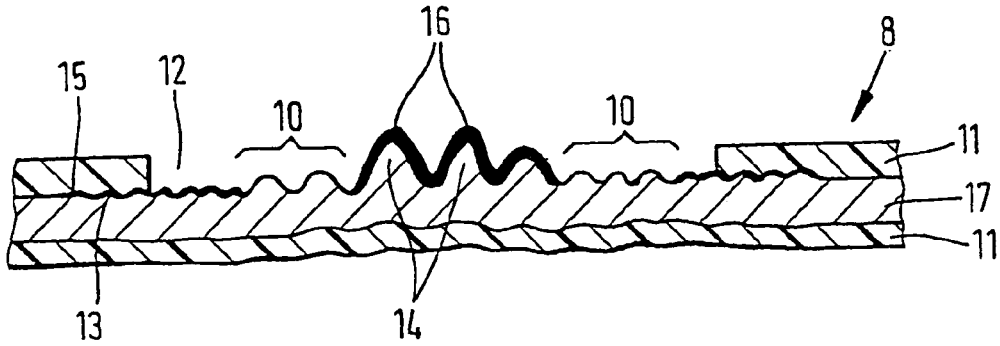
FIG. 4 shows a cross section through an inventive area along B-B in FIG. 2.

FIG. 4 shows the area 8 depicted in FIG. 2, in cross section along the line B-B. The substrate 17, preferably consisting of a cotton/cellulose mixture, is again coated with foil 11 on the front and back, the foil having an inventive—here rectangular—gap 12 on the front. Furthermore, the substrate is equipped with intaglio printing that is tactilely perceptible to different extents and a blind embossing 10. The finely structured guilloche pattern 9 shows weak embossing 13 and little inking 15, while the writing "DE" shows strong embossing 14 and thicker inking 16. In comparison with the area 7, the area 8 has a blind-embossed area 10. To produce said blind-embossed area, the engravings of the printing plate are not, or at least partly not, inked, i.e. not filled with printing ink, before the printing operation. The non-inked area of the printing plate acts only as an embossing plate with which the stated blind embossings can be produced on a substrate during the intaglio printing operation. The embossed elements have similar proportions and tactile properties to the printed areas, with the exception of the visual impression produced by the printing ink. In FIG. 4 there are medium-strong blind embossings which can also be perceived tactilely.

The invention claimed is:

1. A data carrier having a first side and a second side, said data carrier comprising:

at least one printed area produced by imprinting via intaglio printing on the first side and having a tactile perceptibility produced by the imprinting, said printed area having a printing relief of approximately 5 to 100 microns; and a protective foil applied on the first side and partly covering said printed area, wherein the protective foil is applied such that the tactile perceptibility of the intaglio printing is maintained;

wherein the tactile perceptibility of said printing relief of said printed area is greater in areas not covered by said protective foil than in areas covered by said protective foil.

2. A data carrier according to claim 1, wherein the printed area additionally comprises a blind-embossed area.

3. A data carrier according to claim 1, wherein at least one partial area of the non-covered printed area is tactilely perceptible.

4. A data carrier according to claim 1, wherein the foil has at least one gap in the area of the printed area.

5. A data carrier according to claim 1, wherein the data carrier is an identification document.

6. A data carrier according to claim 1, wherein the foil has holographic embossed structures.

7. A data carrier according to claim 1, wherein the foil has a thickness of less than 20 μm.

8. A data carrier according to claim 1, wherein the printed area has a finely structured pattern.

9. A data carrier according to claim 1, wherein the printed area has a pattern which extends essentially seamlessly between the area covered with foil and the uncovered area.

10. The data carrier of claim 8, wherein said finally structured pattern comprises guilloches.

11. The data carrier according to claim 1, wherein said foil comprises polyethylene terephthalate (PET) or thermoplastics.

12. A data carrier having a first side and a second side, said data carrier comprising:

at least one printed area including an intaglio imprint on the first side and having a tactile perceptibility, said printed area having a printing relief of approximately 5 to 100 microns; and a protective foil applied on the first side and partly covering said printed area, wherein the protective foil is applied such that the tactile perceptibility of the intaglio printing is maintained;

wherein the tactile perceptibility of said printing relief of said printed area is greater in areas not covered by said protective foil than as covered by said protective foil.

13. A data carrier according to claim 1, wherein the printing relief of the printed area in areas covered by the protective foil is under 50 microns, and at least a portion of the printing relief of the printed area in areas not covered by said protective foil is over 50 microns.

14. A data carrier according to claim 12, wherein the printing relief of the printed area in areas covered by the protective foil is under 50 microns, and at least a portion of the printing relief of the printed area in areas not covered by said protective foil is over 50 microns.

15. A data carrier according to claim 4, wherein the at least one gap has an area of 1 to 4 $cm^2$.

16. A data carrier according to claim 4, wherein the at least one gap and the printed area are centered relative to each other.

17. A data carrier according to claim 4, wherein an area of the at least one gap is smaller than the printed area.

* * * * *